United States Patent [19]

Kast et al.

[11] 4,310,982

[45] Jan. 19, 1982

[54] MAGAZINE SPRING RETAINER AND CAP DETENT SYSTEM

[75] Inventors: Jack L. Kast, Ilion, N.Y.; Edgar J. Young, Beacon Falls, Conn.

[73] Assignee: Remington Arms Company, Inc., Bridgeport, Conn.

[21] Appl. No.: 124,799

[22] Filed: Feb. 26, 1980

[51] Int. Cl.[3] ..... F41C 27/00; F41C 25/08

[52] U.S. Cl. ..... 42/75 B; 42/49 R

[58] Field of Search ..... 42/49 R, 75 B, 75 A, 42/17

[56] References Cited

U.S. PATENT DOCUMENTS 2,402,086 6/1946 Rix ..... 42/75 B 4,087,930 5/1978 Grehl ..... 42/75 B

FOREIGN PATENT DOCUMENTS 219418 9/1968 U.S.S.R. ..... 42/49 R

*Primary Examiner*—Charles T. Jordan

*Attorney, Agent, or Firm*—Nicholas Skovran; William L. Ericson; Barry Estrin

[57] ABSTRACT

A detent system for tubular magazine firearms serving the dual function of retaining the magazine spring within the magazine tube when the cap has been removed while also acting as a detent to keep the magazine cap securely tightened during normal use. A plastic member is provided with full and partial longitudinal slots which cooperate with indents on the magazine tube to facilitate assembly of the detent system within the tube. The slots and detents also cooperate to maintain the plastic member securely spring biased in a position so that serrated teeth along a peripheral end surface will intermesh teeth on the inside periphery of the cap in order to maintain the latter securely fastened to the magazine tube.

8 Claims, 7 Drawing Figures

MAGAZINE SPRING RETAINER AND CAP DETENT SYSTEM

BACKGROUND OF THE INVENTION

The present invention relates to firearms, and more particularly to firearms having a tubular magazine wherein a plurality of shotgun shells are loaded into the magazine tube for automatically feeding to the receiver. Specifically, the invention relates to an improved means for retaining the magazine spring within the tubular magazine in spring bias against the column of shotgun shells in the loaded magazine when the cap is removed, and also for detenting the magazine cap so as to prevent it from coming loose during normal use.

Certain shoulder firearms such as repeating shot-guns include tubular magazines secured to the forward end of the receiver. The magazine tube is commonly enclosed within the fore-end of a removable stock, usually made of wood. Shotgun shells are loaded into a magazine tube and are spring biased toward the receiver so as to permit automatic reloading after firing. The forward end of the magazine tube is closed by a cap threaded thereon. This cap also constitutes the forward abutment for the fore-end stock so that a tightly threaded cap will securely maintain the fore-end stock in place.

During normal use, the actions of the barrel recoil upon firing, ejection of the fired shell and subsequent reload tend to loosen the magazine cap. Without some detent mechanism, the cap will come completely off, thereby causing the spring and associated parts within the magazine tube to be expelled forward accidentally.

Several types of detent systems have been used in the past to prevent loosening of the magazine cap. One is described in U.S. Pat. No. 2,402,086 to Leon A. Rix, assigned to the assignee of the present invention, wherein the fore-end of the tube has a bushing brazed thereon provided with a circumferential series of ratchet teeth. A separate detent washer with a circumferential series of ratchet teeth is biased by the magazine spring against the inner end of the bushing so as to mesh with its ratchet teeth. The detent washer is provided with a protrusion which is intended to fit into a slot in the magazine cap so that, as the cap is tightened, the slot will engage the projection. Further tightening of the cap causes the teeth of the detent washer to engage those of the bushing until they are in fully seated meshing engagement. The cap is thus resiliently held against turning relative to the magazine tube.

Another prior art detent system is the subject of U.S. Pat. No. 4,087,930 to William H. Grehl, in which the magazine spring urges two projecting prongs or fingers of a detent member at the fore-end of the magazine tube into engagement with a slotted or notched surface along the inner periphery of the magazine cap. In this system, the spring retainer is a separate element from the detent member and the former must be friction fit to the wall of the magazine tube.

In yet another prior art detent system, a single detent is located along the circumference of a metal frame located within the fore-end stock. The detent is biased by its own spring to engage slots along the outer periphery of the magazine cap and thus detent the latter. This detent system is currently used on automatic shotguns manufactured by the assignee of the present invention under the designation "Model 1100" series.

The foregoing prior art systems, while accomplishing to some extent their purpose in keeping the magazine cap from unscrewing accidentally, suffer from several disadvantages. The Rix detent system is rather complex, requiring brazed bushings and constructed so that the magazine spring cannot be removed from cleaning when the cap is removed. Grehl requires a separate spring retainer which is friction fit to the wall of the magazine tube and is therefore difficult to get out. And the last-mentioned detent system requires a separate spring for the detent and a separate retainer for the magazine spring. It also does not permit substitution of more desirable and ligher weight aluminum caps in place of steel caps since the detent system tends to damage the former.

BRIEF SUMMARY OF THE INVENTION

The present invention is believed to obviate the disadvantages of the prior art by providing a simple detent system capable of serving the dual purpose of a spring retainer and a cap detent. The magazine tube is provided with indented portions intended to cooperate with a simple plastic member which is provided with both full and partial longitudinal slots, as well as serrated teeth along its peripheral end facing the cap. The latter are intended to intermesh with similar teeth along the inner periphery of the cap.

As a magazine spring retainer, the detent system of the present invention acts as a positive stop to keep the spring within the magazine when the cap is removed. It is also inherently safer than friction-held spring retainers. As a magazine cap detent, it will tend to wear less while holding the cap as tightly as the prior art detent designs. And of course, the plastic member of the detent systems serves a dual function, thus making it more economical to produce and use than prior art systems requiring separate elements for each of these functions.

The nature and novel features which are characteristic of the present invention, as well as the objects and advantages thereof, will become more apparent from consideration of the following description taken in connection with the accompanying drawings, in which:

DETAILED DESCRIPTION OF A PREFERRED EMBODIMENT

Figure 1:
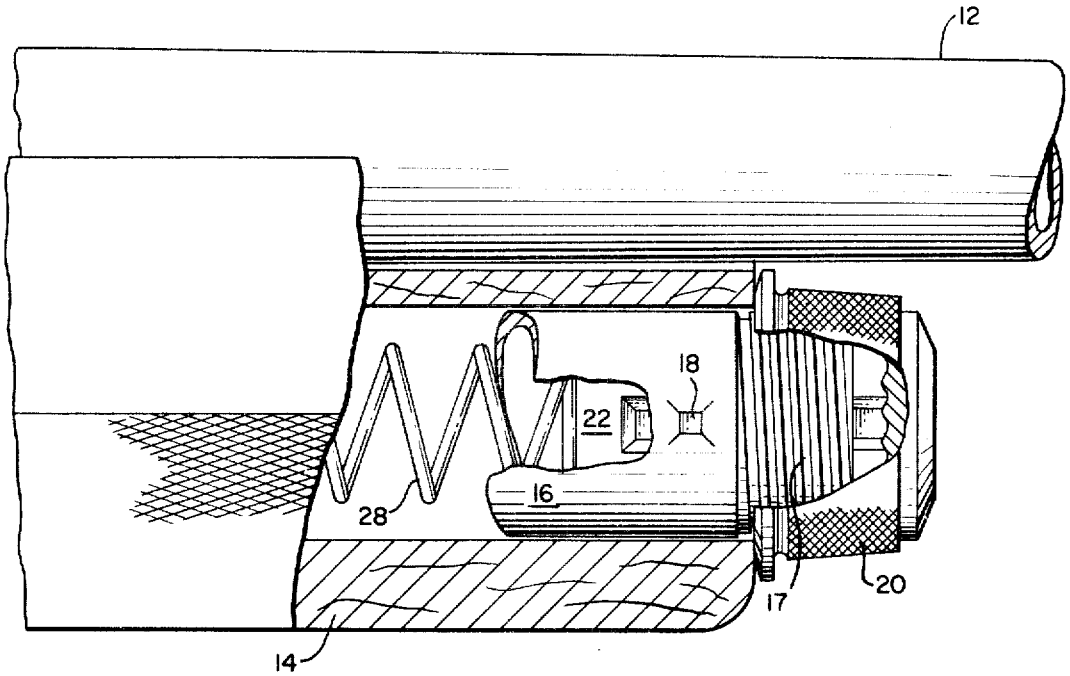
FIG. 1 is a fragmentary view in side elevation of the fore-end stock portion of a tubular magazine shotgun embodying a preferred embodiment of the present invention.

A fragmentary view of the fore-end stock 14 of an automatic shotgun incorporating a preferred embodiment of the present invention is illustrated in FIG. 1. As is common in automatic shotguns, a tubular magazine or magazine tube 16 is located below the gun barrel 12 within the stock 14. One end of the magazine tube 16 fits into an opening in the receiver (not shown) for feeding shotgun shells to the reloading mechanism (not shown)

of the gun. A magazine spring 28 within the tubular magazine 16 presses rearwardly against a magazine follower (not shown), which in turn will continuously exert a rearward force against the column of shotgun shells which may be loaded in the magazine tube 16.

The fore-end stock 14 completely surrounds the tubular magazine 16 and a cap 20 is screwed onto the threaded end 17 of the magazine tube 16 projecting a short distance beyond the fore-end stock 14. As the cap 20 is tightened, it engages the end of the stock 14 and forces it rearward to assist in holding the stock securely in place. When the cap 20 is unscrewed and removed from the threaded end 17 of the magazine tube 16, the fore-end stock may be slipped forward to expose the tubular magazine and other portions of the gun.

The foregoing general arrangement of the fore-end stock portion of a firearm with a tubular ammunition magazine is typical of such automatic or semi-automatic shotguns. The present invention is also applicable to types of tubular magazine firearms such as, for example, slide and pump action guns wherein the fore-end is moved longitudinally for reciprocating the breech-bolt and actuating the reloading mechanism.

Figure 2:
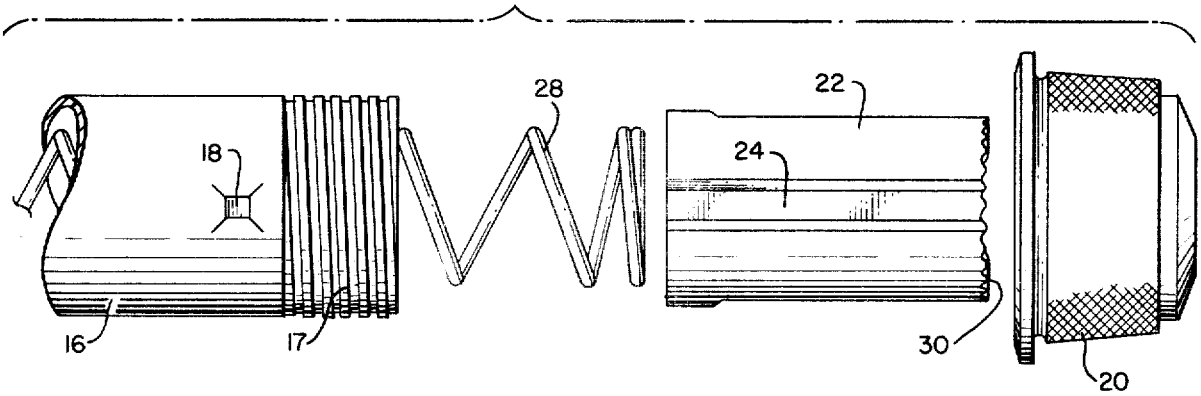
FIG. 2 is an exploded side view with the fore-end stock removed illustrating the components of the present invention prior to assembly.

Referring more particularly to FIG. 2, the components of the magazine tube assembly of the present invention are illustrated in a non-assembled state. These include the cap 20 and the magazine spring 28 described above. It should be noted that the magazine tube 16 has two detents 18 along its periphery spaced 180° apart and located near the threaded end 17.

Figure 7:
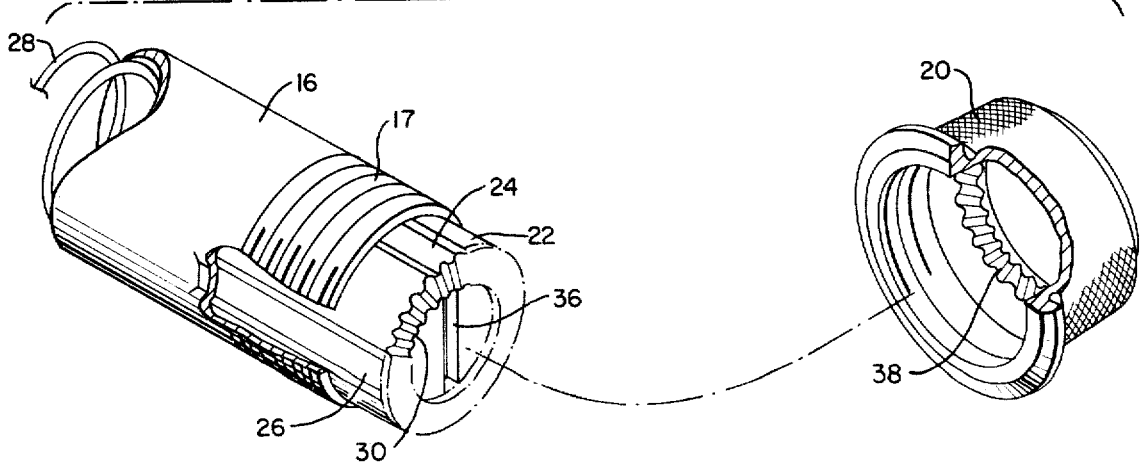
FIG. 7 is a perspective view of FIG. 5 illustrating the assembled invention without the cap screwed thereon.

Also included in the magazine tube fore-end assembly is a cylindrical shaped plastic member 22 which functions both as a retainer and a detent, and which will, accordingly, be hereinafter referred to as "retainer/detent." As noted earlier, the retainer/detent 22 serves a dual function. It retains the magazine spring 28 in the magazine tube 16 when the cap 20 is removed. It also employs the spring force of the magazine spring 28 to detent the magazine cap 20 by means of the interacting teeth forming a detent surface 30 at the peripheral edge of the retainer/detent and a corresponding detent surface 38 disposed at an inner periphery of the magazine cap (FIG. 7). Both detent surfaces are in the form of a circumferential series of serrations with intermeshing wave form type teeth.

Figure 4:
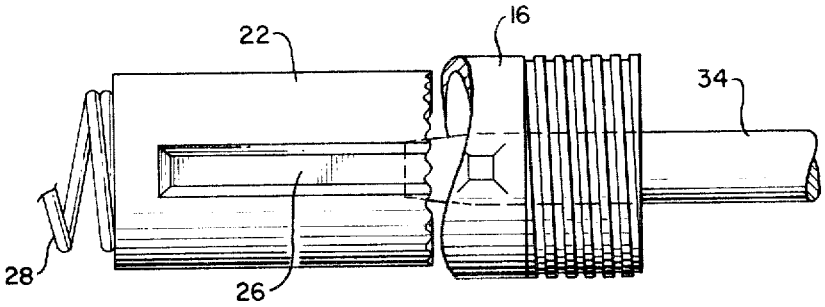

The retainer/detent 22 further includes four longitudinal slots. Two are full slots 24 in that they extend along the entire longitudinal length of the retainer/detent and are spaced 180° apart. The other two are partial slots 26 which extend a major portion but not the entire length of the retainer/detent 22, as shown in FIG. 4. Partial slots 26 are also spaced 180° apart so that each is 90° from one of the full slots 24, as shown more clearly in the cross-sectional view of FIG. 6. The purpose of these slots will become more apparent as the assembly procedure is described.

In FIG. 2, the retainer/detent 22 is shown properly aligned with the magazine tube 16 for assembly of the fore-end magazine tube components. The full slots 24 are initially lined up with the indents 18 of the magazine tube 16 so that the retainer/detent 22 can be inserted into the tube.

Figure 3:
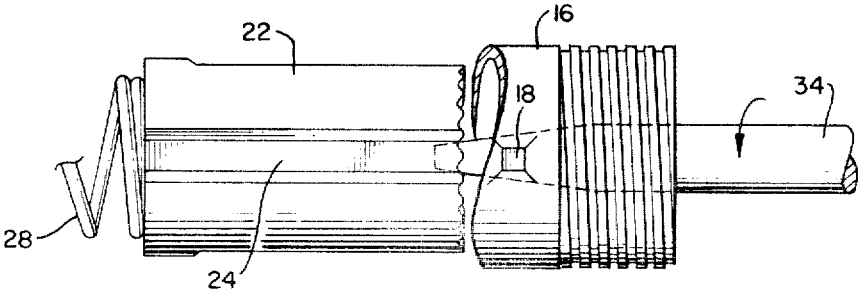
FIGS. 3–5 are side elevations illustrating a procedure for assembling the components of the present invention in the tubular magazine.

FIG. 3 shows the retainer/detent 22 pushed against the force of the spring 28 past the indents 18 by means, for example, of a screwdriver 34. The latter may be inserted conveniently in a slot 36 (FIG. 7) at the fore-end of the retainer/detent 22. By virtue of the full slots 24, the retainer/detent passes into the tube 16 and beyond the detents 18.

Figure 5:
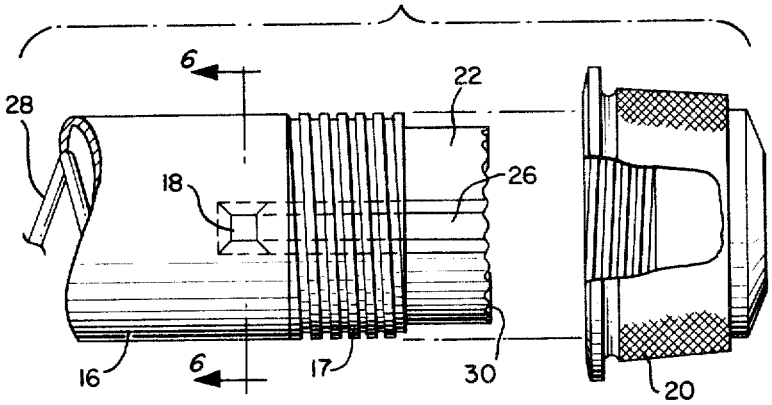

The retainer/detent 22 is then rotated about its axis of symmetry within the tube 16 through an angle of 90° so that the partial slots 26 are now lined up with the indents 18, as shown in FIG. 14. The retainer/detent is then released by removal of the screwdriver 34 so that the spring force will move it axially toward the fore-end of the magazine tube 16 until the end of the partial slots 26 contact and are stopped by the indents 18, as illustrated in FIG. 5. In this position, the retainer/detent 22 functions as the magazine spring retainer.

Figure 6:
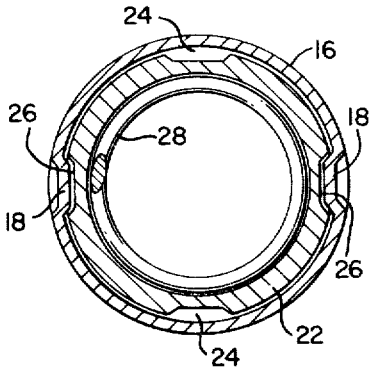
FIG. 6 is a cross-sectional view of FIG. 5 taken along line 6—6.

A cross-sectional view of the retainer/detent 22 within the magazine tube 16 in the spring retainer position of FIG. 5 is shown in FIG. 6. It should be noted that the spring 28 is retained within the retainer/detent 22. Also illustrated are the relative positions of the full slots 24 and the partial slots 26, the latter engaged by the detents 18 of the magazine tube 16.

The magazine cap 20 is then screwed onto the threaded end 17 of the magazine tube 16. When the cap is screwed tight, the retainer/detent 22 also functions as the magazine cap detent, since the magazine spring 28 is pressing the retainer/detent 22 against the inside of the cap. As described earlier and more clearly evident from FIG. 7, the detent surface 30 of the retainer/detent and detent surface 38 along the inside periphery of the magazine cap 20 have matching wave form teeth. When the cap is tightened, the spring bias on the retainer/detent 22 causes the tooth serrations of surfaces 30 and 38 to intermesh and thus inhibit the cap from rotating with respect to the retainer/detent 22. The latter is kept from rotating in the magazine tube 16 by the indents 18. The retainer/detent thus acts as a detent to prevent the magazine cap 20 from coming unscrewed during normal use.

While the particular embodiments of the invention have been described for purposes of illustration, it will be understood that various changes and modifications can be made therein within the spirit of the invention, and the invention accordingly is not to be taken as limited except by the scope of the appended claims.

What is claimed is:

1. In a firearm having a tubular magazine, a cap screwed onto one end of the magazine, and a spring located within the magazine for urging cartridges toward the other end thereof, said firearm further including means for retaining the spring within the tubular magazine when the cap is removed and also for restraining the cap from becoming unscrewed accidentally comprising:

a cylindrical member having a plurality of slots extending longitudinally along its surface and a first detent surface at one end thereof;

indent means associated with the tubular magazine and adapted to cooperate with said slots for inserting the cylindrical member and maintaining said member fixed within the tubular magazine; and a second detent surface associated with the cap and disposed for engagement with the first detent surface as the cap is tightened in order to restrain the cap against accidental rotation.

2. A firearm as defined in claim 1, wherein said first detent surface comprises a plurality of teeth formed along the peripheral edge of said member and said second detent surface comprises a plurality of teeth of similar waveform formed along an inner periphery of the cap.

3. A firearm as defined in claim 1, wherein said member includes two slots extending the full length of the member and two slots extending only a partial length, said full length slots adapted to cooperate with said indent means to permit insertion of the member within the tubular magazine and said partial length slots adapted to cooperate with said indent means to maintain said member fixed within the tubular magazine.

4. A firearm as defined in claim 3, wherein both full length slots and both partial length slots are alternately spaced approximately 90° apart and the indent means comprises indented portions formed in the wall of the tubular magazine which are spaced 180° apart.

5. A detent device for a magazine cap on the fore-end of a magazine tube in a firearm comprising a cylindrical member within the fore-end of the tube and having a pair of slots extending fully along its longitudinal length and a pair of slots extending partially along its longitudinal length, said member provided with tooth serrations along one of its peripheral ends.

6. The detent device defined in claim 5 wherein the angular spacing between the full length slots of said member corresponds to the angular spacing of a pair of indented portions formed in said magazine tube to enable the member to be fully inserted into the tube along the full length slots against the force of a spring contained within the tube.

7. The detent device defined in claim 6 wherein the angular spacing between the partial length slots also corresponds to that of said indented portions so that, when the inserted member is rotated about its axis of symmetry until the indented portions and partial length slots are in alignment, the indented portions will enter and slide into and to the end of the partial slots by reason of the force of the spring, said member being maintained thereby in a fixed radial position relative to the magazine tube.

8. The detent device of claim 5 wherein the tooth serrations of said member are of similar waveform to a plurality of tooth serrations disposed within an inner periphery of the magazine cap so that, as the cap is screwed onto the magazine tube, the serrations will intermesh and prevent the cap from accidently rotating.

* * * * *